US006117049A

United States Patent [19]

Lowe

[11] Patent Number: 6,117,049

[45] Date of Patent: Sep. 12, 2000

[54] EXERCISE EQUIPMENT WEIGHT SELECTOR

[76] Inventor: John C. Lowe, 7104 River Rd., Bethesda, Md. 20817-4770

[21] Appl. No.: 09/417,110

[22] Filed: Oct. 13, 1999

[51] Int. Cl.[7] ..... A03B 21/06

[52] U.S. Cl. ..... 482/4; 482/8; 482/94; 482/98

[58] Field of Search ..... 482/4, 5, 8, 93, 482/94, 97–103

[56] References Cited

U.S. PATENT DOCUMENTS

| | | | |
|---|---|---|---|
| 4,746,113 | 5/1988 | Kissel . | |
| 5,476,428 | 12/1995 | Potash et al. . | |
| 5,655,997 | 8/1997 | Greenberg et al. | 482/5 |
| 5,876,313 | 3/1999 | Krull | 482/98 |
| 6,015,367 | 1/2000 | Scaramucci | 482/5 |

FOREIGN PATENT DOCUMENTS 2 613 237 A1 10/1988 France .

*Primary Examiner*—John Mulcahy
*Attorney, Agent, or Firm*—Laubscher & Laubscher

[57] ABSTRACT

An automatic weight selector for exercise equipment is characterized by a screw mechanism for adding or subtracting weight applied to a carriage on the equipment. A plurality of weights are slidably connected with the equipment. The weights contain central threaded through-openings which are in alignment when the weights are arranged in a stack. The screw mechanism has a vertical axis aligned with the threaded openings in the weights. Thus, the screw can be rotated to connect or disconnect one or more weights to the carriage. A remote-controlled motor is provided to rotate the screw, thereby enabling a user to easily and automatically adjust the weight applied to the exercise equipment.

10 Claims, 2 Drawing Sheets

EXERCISE EQUIPMENT WEIGHT SELECTOR

BACKGROUND OF INVENTION

In health clubs and in the home, exercise equipment exists for use by individuals to exercise their muscles, rehabilitate injuries, and improve their fitness. From standing, sitting, and prone positions, a user pulls, pushes, lifts, or rotates handles or bars on the equipment, which offer resistance to the force exerted by the user. In some exercise devices the resistance is from hydraulic or pneumatic cylinders connected with the equipment. In other devices the resistance is from a plurality of weights. The present invention relates to exercise equipment of the type including a plurality of weights. Specifically, the invention relates to a mechanism for automatically selecting the number of weights, and thus the resistance force, by the user for a particular exercise.

BRIEF DESCRIPTION OF THE PRIOR ART

Various weight selection devices for exercise machines are known in the patented prior art, as evidenced by the French patent No. 2613237. As disclosed therein, a stack of weights is arranged beneath a carriage having a cross bar above the weights and depending uprights on opposite sides of the stack. A central rod passes through the weights and a pulley mechanism is connected with the carriage to raise and lower the same. In order to connect a desired number of weights with the carriage, various mechanisms are disclosed including cursors, pins, levers, and an electromagnet.

The Kissel U.S. Pat. No. 4,746,113 discloses an automatically adjustable exercise device which uses a weight changing system that includes a body carrying a plurality of pins that can be automatically displaced depending on the strength of the person using the equipment.

While the prior devices operate satisfactorily, they possess certain inherent drawbacks that make them somewhat difficult and complicated for changing the weight applied to the equipment. They also do not lend themselves to remote operation. Thus, the user must dismount the equipment or otherwise stop exercising to make a change in the selected weight. The present invention was developed in order to overcome these and other drawbacks of the prior devices by providing an improved weight selector for exercise equipment, which is capable of remote and easy operation.

SUMMARY OF THE INVENTION

Accordingly, it is a primary object of the invention to provide an exercise device including a frame with which a plurality of weights are slidably connected in stacked relation. Each weight contains a threaded through-opening aligned with the openings of the weights in the stack. A displacement mechanism is connected with the frame and the weights through which a user displaces the weights to exercise the body. An automated weight selector connects the weights with the displacement mechanism. The selector comprises a screw having a vertical axis aligned with the through-opening in the weights. The outer diameter of the screw corresponds with the diameter of the openings in the weights so that when the screw is rotated in a first direction, it progressively passes through and is connected with a selected number of weights in accordance with the desired weight to be applied to the exercise equipment. When the screw is rotated in an opposite direction, the screw is progressively withdrawn from a selected number of weights to disconnect them from the equipment.

According to a more specific embodiment of the invention, a motor is connected with the screw to rotate it in the first and opposite directions. The motor is remotely controlled by the user so that the weight can be easily and automatically adjusted.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
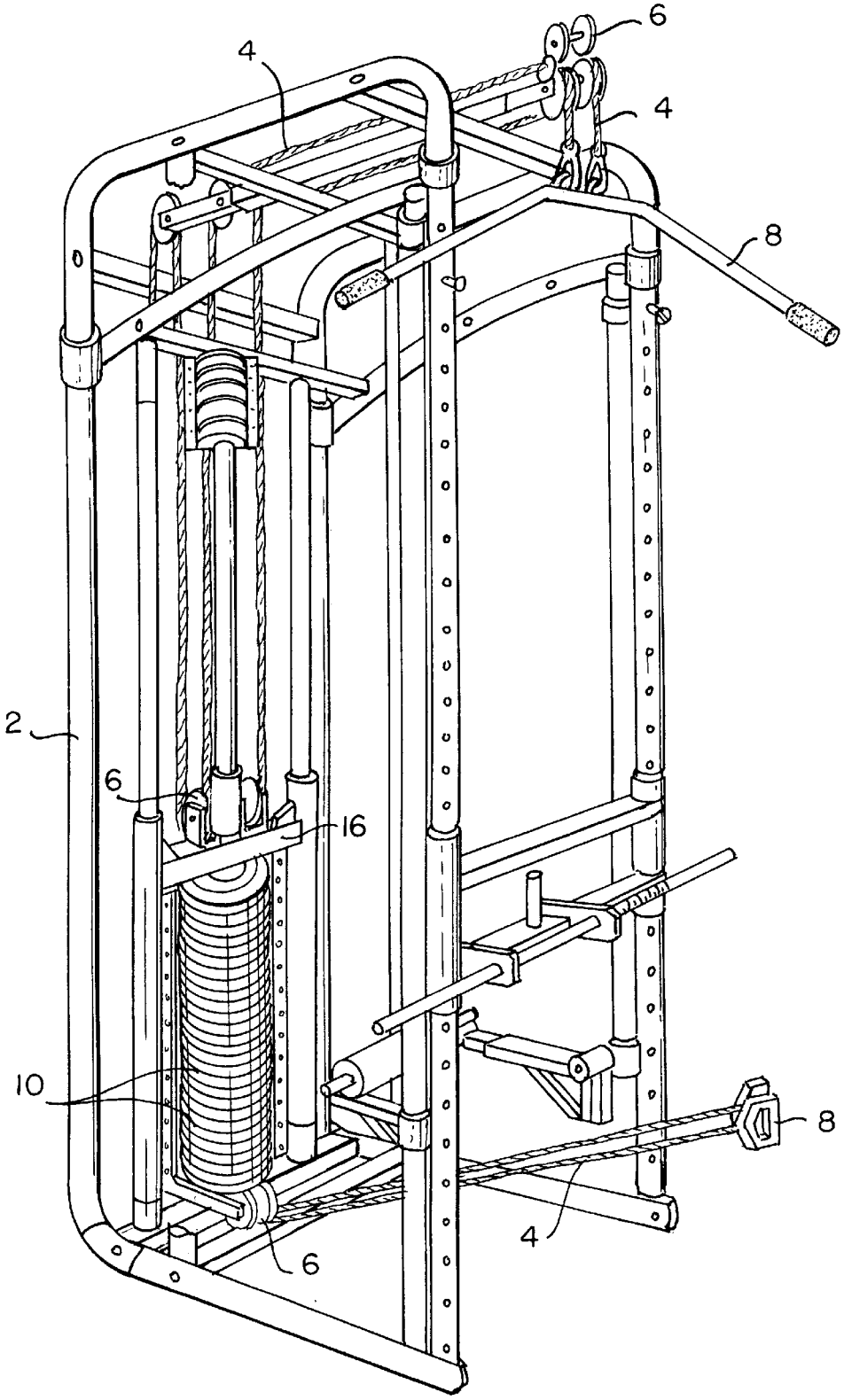
FIG. 1 is a perspective view of an exercise device including the weight selector for the present invention.

An exercise device of the type for which the weight selector of the present invention is suitable is shown in FIG. 1. It includes a frame 2 adapted for mounting on a wall or resting on a floor. Connected with the frame are a series of ropes or cables 4 and pulleys 6 at the ends of which are handles 8 which may be gripped by the user for exercising various muscles throughout the body in a known manner. The frame may also include a bench and other force resistant devices such as bars, pads, and the like (not shown) that can be pulled, pushed, or rotated by the user against a resistance, as is well-known in the exercise equipment art.

Figure 2:
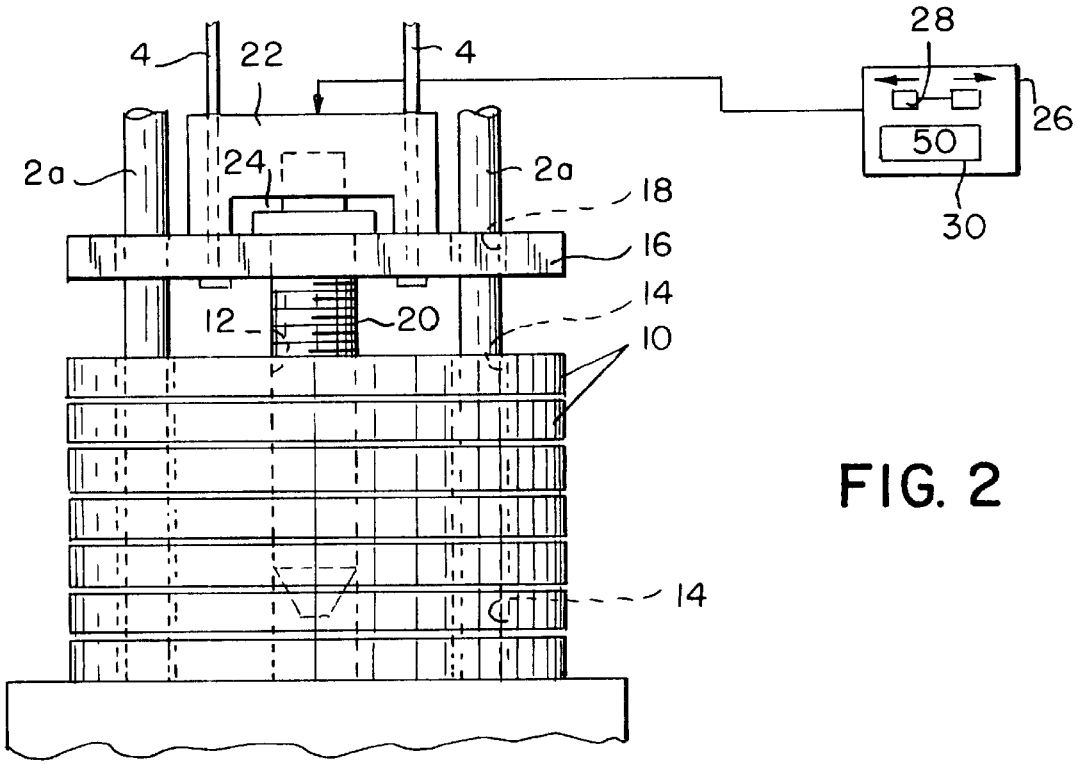
FIG. 2 is a detailed plan view of a first embodiment of the weight selector.
Figure 3:
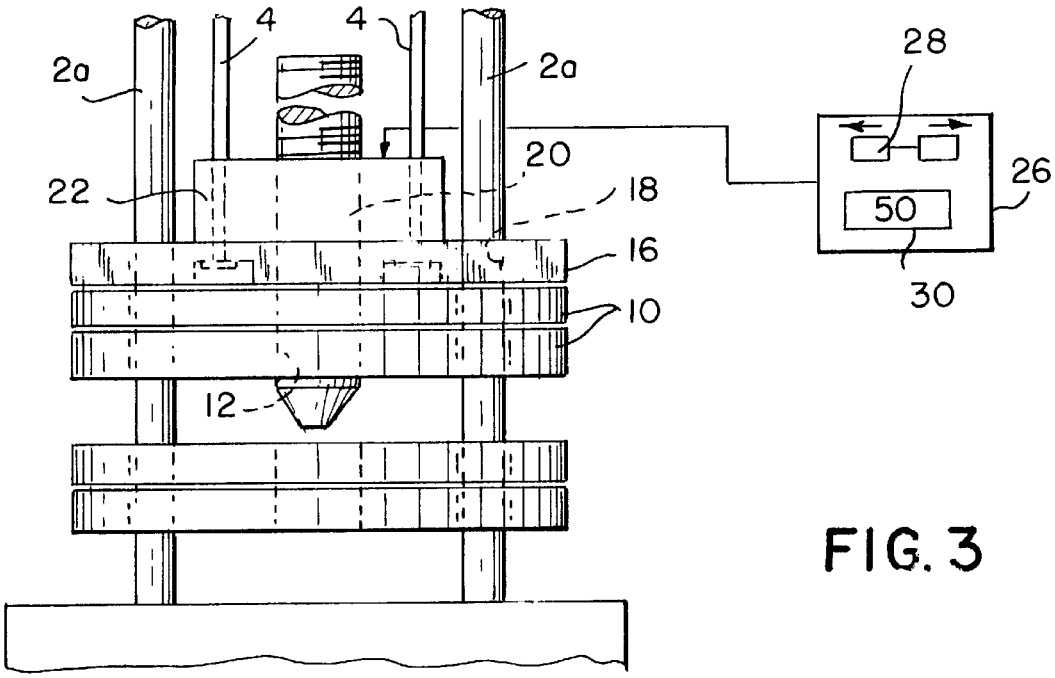
FIG. 3 is a detailed plan view of a second embodiment of the weight selector.

Slidably connected with the frame are a plurality of weights 10 arranged in stacked relation. Referring now to FIGS. 2 and 3, the weights are preferably of the same size, configuration, and weight, and each contains a threaded through-opening 12 preferably in the center thereof. All of the through-openings 12 in the weights 10 are in alignment. Each weight also preferably contains additional through-openings 14 adjacent to the side portions thereof for receiving vertical legs 2*a* of the exercise frame. The through-openings 14 are oversized slightly relative to the legs to afford vertical sliding movement of the weights with respect to the frame.

Above the stack of weights is arranged a carriage 16. The carriage is connected with the cables 4 of the exercise equipment, either directly as shown in FIGS. 2 and 3 or via pulleys 6. The carriage also is slidably connected with the legs 2*a* via oversized through-openings 18 in the same manner as the weights. Thus, when tension is applied to the cables 4, the carriage is raised relative to the frame legs 2*a*.

Connected with the carriage is a screw 20 having a vertical axis aligned with the threaded through-openings 12 in the weights 10. The screw has an outer diameter corresponding with the diameter of the threaded openings. Accordingly, when the screw is rotated in a first direction, it progressively passes through and connects with one or more of the weights, thereby increasing the net weight applied to the carriage and thus the resistance on the cables. Conversely, when the screw 20 is rotated in the opposite direction, it progressively retreats from the stack of weights, sequentially disconnecting the weights from the bottom of the stack to lighten the resistance or load from the carriage and cables.

While the screw 20 can be rotated manually by the user (via a handle for example) to select the number of weights connected with the carriage and cable system, the carriage preferably has a reversible motor 22 mounted thereon to rotate the screw in both directions. In the embodiment of FIG. 2, the screw 20 is connected with the motor 22 via a journal bearing 24 at one end so that the screw does not traverse the motor. In the embodiment of FIG. 3, the screw traverses through the motor as the screw rotates.

The motor is remotely controlled via a control device 26 which may either be directly connected with the motor via a wire or electronically connected via a wireless transmitter. In either case, the control device preferably includes a simple forward and reversing switch 28 for operating the motor in the first and opposite directions to rotate the screw. An indicator 30 is also provided on the control device to display to the user the amount of weight connected with the carriage.

With the automatic weight selector of the present invention, the user can easily and automatically adjust the total weight connected with the carriage without having to dismount the exercise apparatus. This enables the weight to easily be changed between repetitions of an exercise.

While in accordance with the provisions of the patent statute the preferred forms and embodiments of the invention to be illustrated and described, it will be apparent to those of ordinary skill in the art that various changes and modifications may be made without deviating from the inventive concepts set forth above.

What is claimed is:

1. Apparatus for adjusting the weight applied by the user of exercise equipment, comprising (a) a plurality of stacked weight elements, each of said elements containing a threaded through-bore, said threaded through-bores being vertically aligned;

(b) means for selectively connecting said weight elements to the exercise equipment, said connecting means comprising a screw having an axis aligned with said through-bores and a diameter corresponding with the diameter of said through-bores, said screw being rotated to pass through said stack of weight elements to threadably engage each weight as said screw passes therethrough, whereby when said screw is rotated in a first direction, said screw progressively passes through a selected number of weight elements in accordance with the desired weight to be connected with the exercise equipment, and when said screw is rotated in an opposite direction, said screw is progressively withdrawn from a selected number of weight elements to disconnect a selected number of weight elements from the exercise equipment;

(c) a motor for rotating said screw; and (d) a journal bearing for connecting said screw with said motor, whereby said screw is prevented from traversing through said motor as said screw rotates.

2. Apparatus as defined in claim 1, and further comprises a remote control device for controlling the operation of the motor to rotate said screw in said first and opposite directions.

3. Apparatus as defined in claim 2, wherein said remote control device includes means for indicating the amount of weight connected with the exercise equipment.

4. Apparatus as defined in claim 2, wherein said remote control device is connected with said motor via a cable.

5. Apparatus as defined in claim 3, wherein said remote control device comprises a wireless transmitter.

6. An exercise device, comprising (a) a frame;

(b) a plurality of weights arranged in stacked relation and slidably connected with said frame;

(c) a displacement mechanism connected with said frame and said weights through which a user displaces at least one of the weights to exercise various muscles of the body;

(d) means for selectively connecting said weights with said displacement mechanism, said connecting means comprising a screw having a vertical axis, said weights each containing threaded through-openings aligned with the axis of said screw, said through openings having a diameter corresponding with the diameter of said screw, said screw being rotated to pass through said stack of weights to threadably engage each weight as said screw passes therethrough;

(e) a motor for rotating said screw; and (f) a journal bearing for connecting said screw with said motor, whereby said screw is prevented from traversing through said motor as said screw rotates, and further whereby when said screw is rotated in a first direction, said screw progressively passes through a selected number of weights in accordance with the desired weight to be connected with the exercise equipment, and when said screw is rotated in an opposite direction, said screw is progressively withdrawn from a selected number of weights to disconnect a selected number of said weights from the exercise equipment.

7. An exercise device as defined in claim 6, and further comprising a remote control device for controlling the operation of the motor to rotate said screw in said first and opposite directions.

8. An exercise device as defined in claim 7, wherein said remote control device includes means for indicating the amount of weight connected with exercise equipment.

9. An exercise device as defined in claim 8, wherein said remote control device is connected with said motor via a cable.

10. An exercise device as defined in claim 8, wherein said remote control device comprises a wireless remote.

* * * * *